United States Patent [19]

Mürrle

[11] 4,063,411

[45] Dec. 20, 1977

[54] STEPPING MECHANISM

[75] Inventor: Kurt Mürrle, Pforzheim, Germany

[73] Assignee: Pforzheimer Uhren-Rohwerke Rudolf Wehner, Pforzheim, Germany

[21] Appl. No.: 732,871

[22] Filed: Oct. 15, 1976

[30] Foreign Application Priority Data

Nov. 6, 1975 Germany ..... 2549816

[51] Int. Cl.[2] ..... G04B 19/24

[52] U.S. Cl. ..... 58/125 B; 58/5; 58/7

[58] Field of Search ..... 58/5, 7, 8, 58, 125 B, 58/126 A

[56] References Cited

U.S. PATENT DOCUMENTS

| | | | |
|---|---|---|---|
| 3,703,805 | 11/1972 | Gantier et al. | 58/5 |
| 3,871,171 | 3/1975 | Charbonnet | 58/116 R |
| 3,878,674 | 4/1975 | Muerrle | 58/125 B |
| 3,879,929 | 4/1975 | Charbonnet | 58/5 |

*Primary Examiner*—Robert K. Schaefer
*Assistant Examiner*—Vit W. Miska

[57] ABSTRACT

A stepping gear is rotatably mounted with freedom of axial movement and formed with an axially facing shoulder and with teeth and tooth spaces defined by said teeth. A rotatably mounted pawl roller has first and second peripheral rings. A spring urges said pawl roller against said stepping gear. The first peripheral ring is adapted to enter one of said tooth spaces to oppose a rotation of said stepping gear. The second peripheral ring radially overlaps said shoulder to limit the freedom of axial movement of said stepping gear.

5 Claims, 2 Drawing Figures

STEPPING MECHANISM

This invention relates to a pawl roller for use with stepping gears, particularly for watch movements. The pawl roller is spring-urged against the stepping gear and has a peripheral ring adapted to enter the space between two teeth of said stepping gear.

In watch movements it is known to provide pivoted pawls and pawl rollers in association with stepping gears. Such pivoted pawls and pawl rollers are required to be easily assembled and to facilitate repairs and also to be structurally simple. These requirements have not all been complied with so far at the same time.

It is an object of the invention to provide simple means which comply with these requirements.

In a pawl roller for stepping gears, particularly for watch movements, which pawl roller is spring-urged against the stepping gear and has a peripheral ring adapted to enter the space between two stepping teeth of said stepping gear, this object is accomplished in that the pawl roller has an additional peripheral ring, which engages an annular shoulder of the stepping wheel to limit the axial freedom of movement of the stepping gear. To that end, the pawl roller comprises two peripheral rings, which differ in diameter, and is formed between said two rings with an annular groove engaged by the bias spring. The larger peripheral ring serves to limit the freedom of axial movement.

According to an additional feature of the invention the pawl roller is captively mounted between two plate lugs which enter said annular grooves on opposite sides of said pawl.

Adjacent to the stepping gear, these plate lugs are sufficiently closely spaced to limit the movement of the pawl roller in the direction toward the stepping gear. Those portions of the plate lugs which are remote from the stepping gear are sufficiently widely spaced to permit of the insertion of the pawl roller between said plate lugs and of an engagement of the spring with the pawl roller in said grooves. These plate lugs permit of a rotatable mounting of the pawl roller in an exactly adjusted position.

Figure 1:
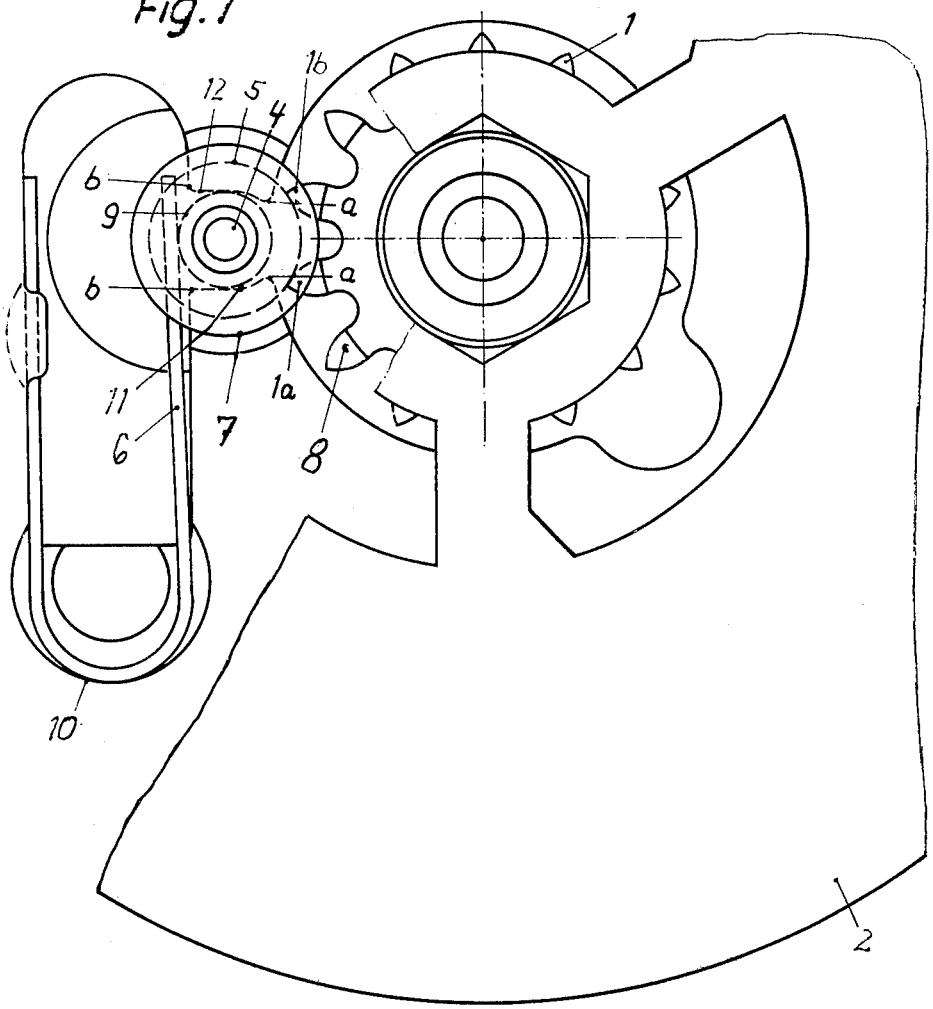
Figure 2:
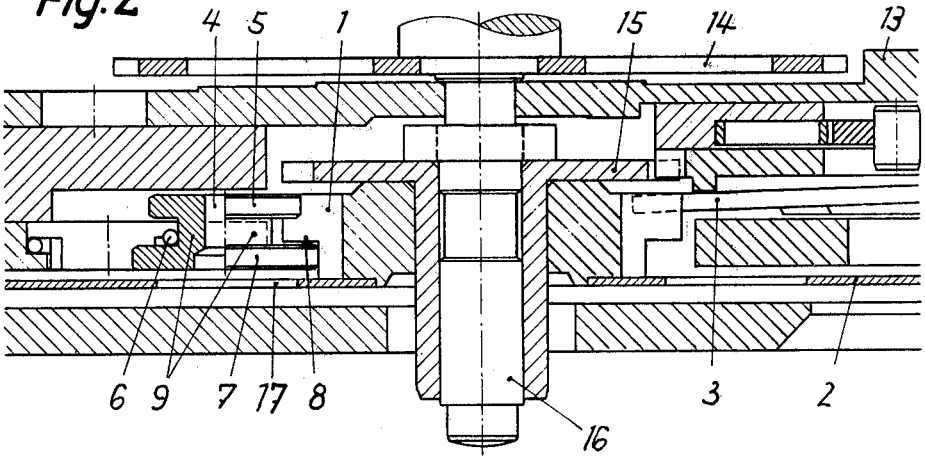

An embodiment of the pawl roller according to the invention is shown by way of example on the drawing, in which FIG. 1 is an elevation showing a star-shaped stepping gear and a pawl roller interengaging therewith and FIG. 2 is a transverse sectional view showing a watch movement which incorporates the gear and roller of FIG. 1.

In the embodiment shown the stepping gear 1 is star-shaped and coupled to the disc 2 for indicating the date of the month or day of the week. Means for actuating the star-shaped stepping gear are indicated at 3 in FIG. 2. Such means for actuating the star-shaped stepping gear may be designed and arranged as disclosed in the pending U.S. Patent Application Serial Number 709,399 of the same inventor (and assigned to the same assignees).

A pawl roller 4 has a smaller peripheral ring 5 and beside the same a larger peripheral ring 7. The smaller peripheral ring 5 normally extends between stepping teeth 1*a*, 1*b*, as is shown in FIG. 1. During a stepping movement of the gear 1, the latter urges the peripheral ring 5 for a short time out of the tooth space against the action of the U-shaped spring 6 so that a tooth can slip past the peripheral ring 5, which subsequently enters the next following tooth space under the action of the spring 6.

The larger peripheral ring 7 of the pawl roller 4 engages a shoulder 8 of the star-shaped stepping gear 1 to limit the freedom of axial movement thereof so that separate axial retaining means are not required. The U-shaped spring 6 is mounted in a spring retainer 10 and extends into an annular groove 9 formed in the pawl roller 4 between the peripheral rings 5 and 7. The spring 6 holds the pawl roller 4 in a bearing provided by two plate lugs 11 and 12, which extend into the annular groove 9 and on one side, at *a—a*, are so closely spaced apart that they prevent an escape of the locking roller, whereas the plate lugs 11 and 12 are sufficiently widely spaced apart on the other side, at *b—b*, to enable the pawl roller to be inserted between the plate lugs and to enable the spring 6 to engage the pawl roller 4. In this way, the plate lugs 11 and 12 ensure that the pawl roller is precisely mounted and, when the U-shaped spring 6 has been mounted, will be captive even when the indicating disc 2 and the star-shaped stepping wheel 1 have been removed.

The sectional view of FIG. 2 shows also the bridge 13, the center wheel 14, and the hour wheel 15 on the cannon pipe 16 as well as the aperture 17 for disengaging the pawl roller 4 for assembling and repair work.

What is claimed is:

1. In a stepping mechanism, in combination, a stepping gear rotatably mounted with freedom of axial movement and formed with an axially facing shoulder and with teeth and tooth spaces defined by said teeth, a rotatably mounted pawl roller having first and second peripheral rings, and a spring urging said pawl roller against said stepping gear, said first peripheral ring being adapted to enter one of said tooth spaces to oppose a rotation of said stepping gear, said second peripheral ring radially overlapping said shoulder to limit the freedom of axial movement of said stepping gear.

2. The combination set forth in claim 1, in which said pawl roller is adapted to assume a first position, in which said first peripheral ring engages two adjacent ones of said teeth to oppose a rotation of said stepping gear, said stepping gear is rotatable to move said pawl roller from said first position radially outwardly with respect to said stepping gear to a second position, in which said pawl roller engages only one of said teeth, and said second peripheral ring radially overlaps said shoulder when said pawl roller is in said first and second positions.

3. The combination set forth in claim 1, in which said second peripheral ring is larger in diameter than said first peripheral ring.

said pawl roller is formed with an annular groove between said peripheral rings, and said spring engages said pawl roller in said groove.

4. The combination set forth in claim 3, in which two plate lugs extend into said annular groove on opposite sides of said pawl roller and are sufficiently closely spaced adjacent to said stepping gear to limit the movement of said pawl roller in the direction toward said stepping gear, and sufficiently widely spaced opposite to said stepping gear to permit of the insertion of said pawl roller between said lugs and of the engagement of said spring with said pawl roller in said groove.

5. In a stepping mechanism of a watch movement, in combination a stepping gear rotatably mounted with freedom of axial movement and formed with an axially facing shoulder and with teeth and tooth spaces defined by said teeth, a rotatably mounted pawl roller having first and second peripheral rings, and a spring urging said pawl roller against said stepping gear, said first peripheral ring being adapted to enter one of said tooth spaces to oppose a rotation of said stepping gear, said second peripheral ring radially overlapping said shoulder to limit the freedom of axial movement of said stepping gear.

* * * * *